United States Patent [19]

Reetz

[11] Patent Number: 4,745,724

[45] Date of Patent: May 24, 1988

[54] OPEN WEB STRUCTURAL SUPPORT MEMBER OF ADJUSTABLE LENGTH WITH INCREMENTAL ADJUSTMENT OF END WEB MEMBER

[75] Inventor: William R. Reetz, Boise, Id.

[73] Assignee: Trus Joist Corporation, Boise, Id.

[21] Appl. No.: 67,606

[22] Filed: Jun. 26, 1987

Related U.S. Application Data

[63] Continuation-in-part of Ser. No. 852,732, Apr. 16, 1986, Pat. No. 4,682,460.

[51] Int. Cl.[4] ..... E04H 12/18; E04C 3/292

[52] U.S. Cl. ..... 52/632; 52/645; 52/691

[58] Field of Search ..... 52/632, 640, 641, 645, 52/691

[56] References Cited

U.S. PATENT DOCUMENTS

| | | | |
|---|---|---|---|
| 1,233,743 | 7/1917 | Arndt | 52/645 X |
| 3,062,340 | 11/1962 | Hunnebeck . | |
| 3,209,508 | 10/1965 | Hunnebeck | 52/632 |

FOREIGN PATENT DOCUMENTS

| | | | |
|---|---|---|---|
| 162969 | 5/1955 | Australia | 52/632 |
| 199851 | 9/1958 | Austria | 52/632 |
| 999716 | 11/1976 | Canada | 52/693 |
| 331145 | 8/1958 | Switzerland . | |

*Primary Examiner*—Alfred C. Perham

*Attorney, Agent, or Firm*—Klarquist, Sparkman, Campbell, Leigh & Whinston

[57] ABSTRACT

An open web structural support member such as a truss is described whose length may be adjusted in predetermined increments and which employs an incremental adjustment means for adjusting the effective length of the end web in order to compensate for adjustment in the length of the truss to maintain a rigid and stable truss. An apertured chord plate is attached to the upper chord member by a pin placed in a selected one of the adjustment holes in such chord plate for adjusting the length of the truss. The chord plate is connected to a mounting bracket at the end of the upper chord member. The incremental adjustment means for the web includes an adjustable link means connected to an end web member to form an end web assembly of adjustable length attached between the mounting bracket and the lower chord member. This adjustable link means including a first link member of fixed length and a second link member having a plurality of adjustment apertures therein and a connecting bolt which is selectively inserted into one of such apertures to change the length of such link member.

20 Claims, 2 Drawing Sheets

FIG. 3
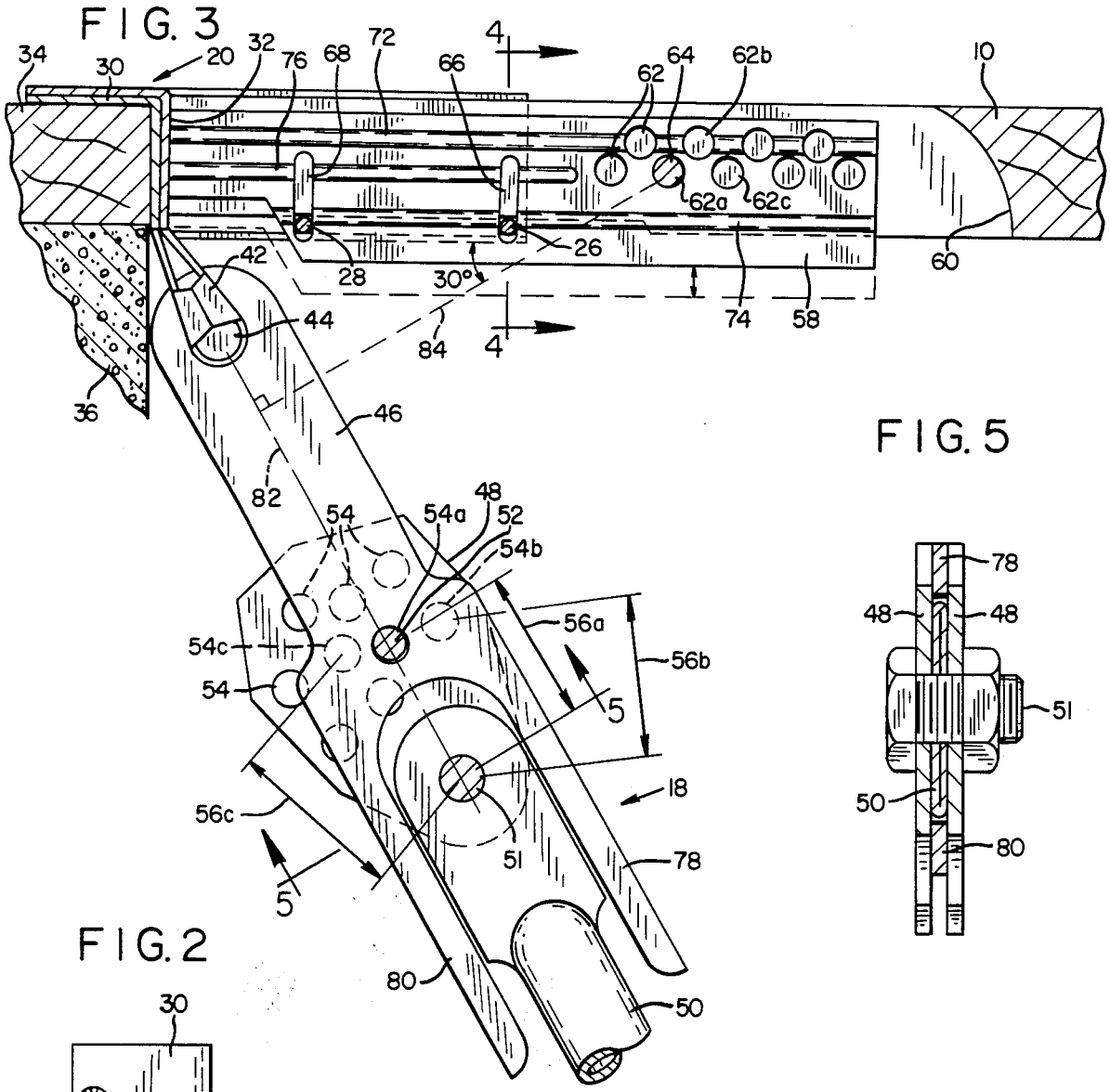
FIG. 5
FIG. 2
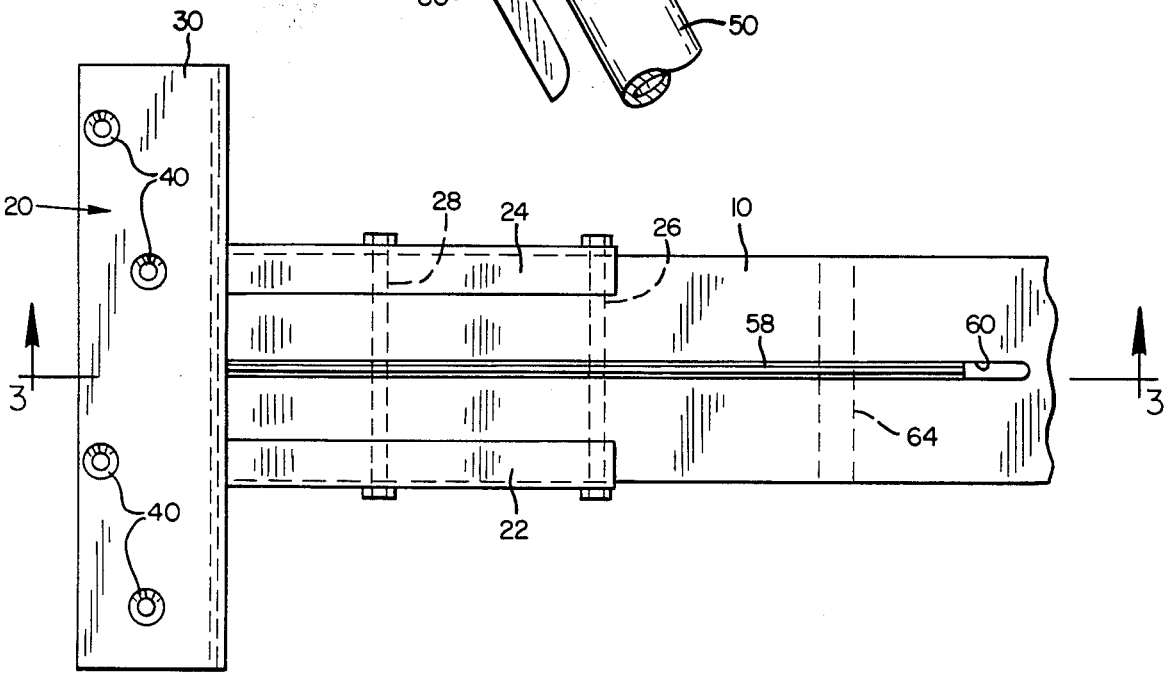

OPEN WEB STRUCTURAL SUPPORT MEMBER OF ADJUSTABLE LENGTH WITH INCREMENTAL ADJUSTMENT OF END WEB MEMBER

REFERENCE TO RELATED APPLICATION

This patent application is a continuation-in-part of pending U.S. patent application Ser. No. 852,732 entitled Open Web Structural Support Mounting Bracket and Length Adjustable Web Member, filed Apr. 16, 1986, by William R. Reetz now U.S. Pat. No. 4,682,460.

BACKGROUND OF INVENTION

This invention relates generally to structural support members of the open web type, such as trusses or joists and, more particularly, to such support members of adjustable length which are mounted on end supports such as walls by means of mounting brackets. The open web structural support member of the present invention is provided with an adjustable connector means including an apertured chord plate for connecting the mounting bracket to the end of the upper chord member in an incrementally adjustable manner in order to adjust the length of the support member between a plurality of different, predetermined length settings. The structural support member also includes an adjustable link means for linking the mounting bracket to the end of a web member positioned at the end of the structural support member to form an end web assembly. The link means has an incremental adjustment means for adjusting the length of such end web assembly in fixed increments between a plurality of different, predetermined web length settings corresponding to the length adjustments of the support member. This incremental adjustment has the advantage that during field installation of the open web structural support member, the proper length of such support member and the corresponding link setting to give the proper length of the end web member can be more easily selected by the installer to provide a rigid and stable support member.

Previously, it has been proposed in U.S. Pat. No. 3,062,340 of Hunnebeck, issued Nov. 6, 1962, to provide metal girder units of the open web truss type for temporary use which may be adjustable in length by adjusting a telescoping extension of the upper boom or chord in predetermined increments. However, unlike the present invention, the end web member of this prior girder apparatus is not provided with incremental adjustment means, but instead is adjusted in a continuous manner by rotation of a threaded rod so that the ultimate adjusted length of the web member may not be of the proper length to match the adjusted length of the truss. This length mismatch can cause the truss to be loose and unstable so that forces applied thereto may result in failure of the truss at lower loads than it was designed to carry. In addition, the continuous adjustment mechanism is too complicated and impractical because each web length adjustment apparatus of such prior girder truss employed two pairs of telescoping web members which were connected together by bridge elements, such bridge elements being threadedly engaged by the threaded adjustment rod for causing telescoping movement of the web members by screw adjustment of such rod for continuously varying the length of the web member. Also, unlike the present invention, the mounting bracket is not a flush mount and is welded to the boom extension so it cannot be used with a variety of chord member sizes. This extremely complicated and expensive adjustment mechanism is inaccurate because it does not position the web member between a plurality of predetermined length settings, which is avoided by the simple and inexpensive adjustable end web assembly of the present invention.

A similar teaching is shown in a later U.S. Pat. No. 3,209,508 by Hunnebeck, issued Oct. 5, 1965, except that the end web member is adjusted by means of a turnbuckle to provide a continuous length adjustment with its resulting disadvantages, rather than incremental adjustment between predetermined web length settings corresponding to the upper boom or chord length settings to provide a rigid, stable truss.

In addition, Swiss Pat. No. 331,145 of Dreyfuss, issued Aug. 30, 1958, shows an adjustable length metal girder or truss similar to U.S. Pat. No. 3,062,340 of Hunnebeck but, however, employs no adjustable length end web member and does not attach its end web member to the mounting bracket. This causes an undesirable eccentric load to be applied to the truss at the end web connection which is avoided by the present invention.

The open web structural support member of the present invention has the additional advantage that the length of such support member can be easily adjusted in the field, merely by removing a pin from the chord plate, sliding the upper chord member relative to the mounting bracket, and then inserting the pin into a different hole in the chord plate attached to such mounting bracket. A corresponding adjustment of the length of the end web assembly is quickly and easily achieved merely by removing a bolt from an adjustment hole in apertured link members and placing it in another hole. As a result of the incremental adjustment of the length of the structural support member or truss and a corresponding incremental adjustment in the length of the end web member, a rigid and stable structural support member is provided with the present invention and inaccurate length adjustments in the field are avoided.

The present structural support member is of improved versatility because its mounting bracket is secured to the chord plate by a pair of bolts which extend through vertical slots in such chord plate and pass beneath the upper chord member to allow chord members of different height to be employed and to accommodate different length adjustment positions of the chord member. In addition, a fixed link member is provided with a pair of fork arms which extend on opposite sides of the end web member to engage such web member and prevent the link-web assembly from collapsing under compressive loads which may be caused by wind uplifts of the lower chord member.

SUMMARY OF INVENTION

It is, therefore, one object of the present invention to provide an improved open-web structural support member of greater strength and rigidity whose length may be adjusted in predetermined increments.

Another object of the invention is to provide such a structural support member having an end web assembly which is adjusted in length with greater accuracy by incremental adjustment between a plurality of different, predetermined length settings corresponding to the adjusted length of the support member.

A further object of the invention is to provide such a structural support member in which the length of the structural member and the length of the end web member may be adjusted in the field quickly and easily to the proper length.

An additional object of the invention is to provide such a structural support member which is more versatile in that it can employ chord members of different height thickness as a result of the mounting bracket and connector means employed.

Still another object of the invention is to provide such an improved structural support member in which an adjustable link means attached to the end web member is provided with fork arms which prevent buckling of the web assembly due to compressive forces such as those caused by wind uplift of the lower chord member.

A still further object of the invention is to provide such a structural support member in which the mounting bracket attached to the end of the upper chord member for mounting on a wall or other end support is connected to the chord member in such a manner to allow any horizontal forces applied to the wall such as during an earthquake to be transmitted from the mounting bracket to the chord more effectively, thereby preventing collapse of the building or other structure supported by such structural support members.

BRIEF DESCRIPTION OF DRAWINGS

Other objects and advantages of the present invention will be apparent from the following detailed description of a preferred embodiment thereof, of which:

FIG. 2 is an enlarged plan view of the top of one end of the structural support member of FIG. 1;

FIG. 3 is a horizontal section view taken along the line 3—3 of FIG. 2 showing the incremental adjustment means for adjusting the length of the support member and for adjusting the length of the end web assembly;

FIG. 5 is an enlarged section view taken along the line 5—5 of FIG. 3.

DETAILED DESCRIPTION OF PREFERRED EMBODIMENT

Figures 1, 4:
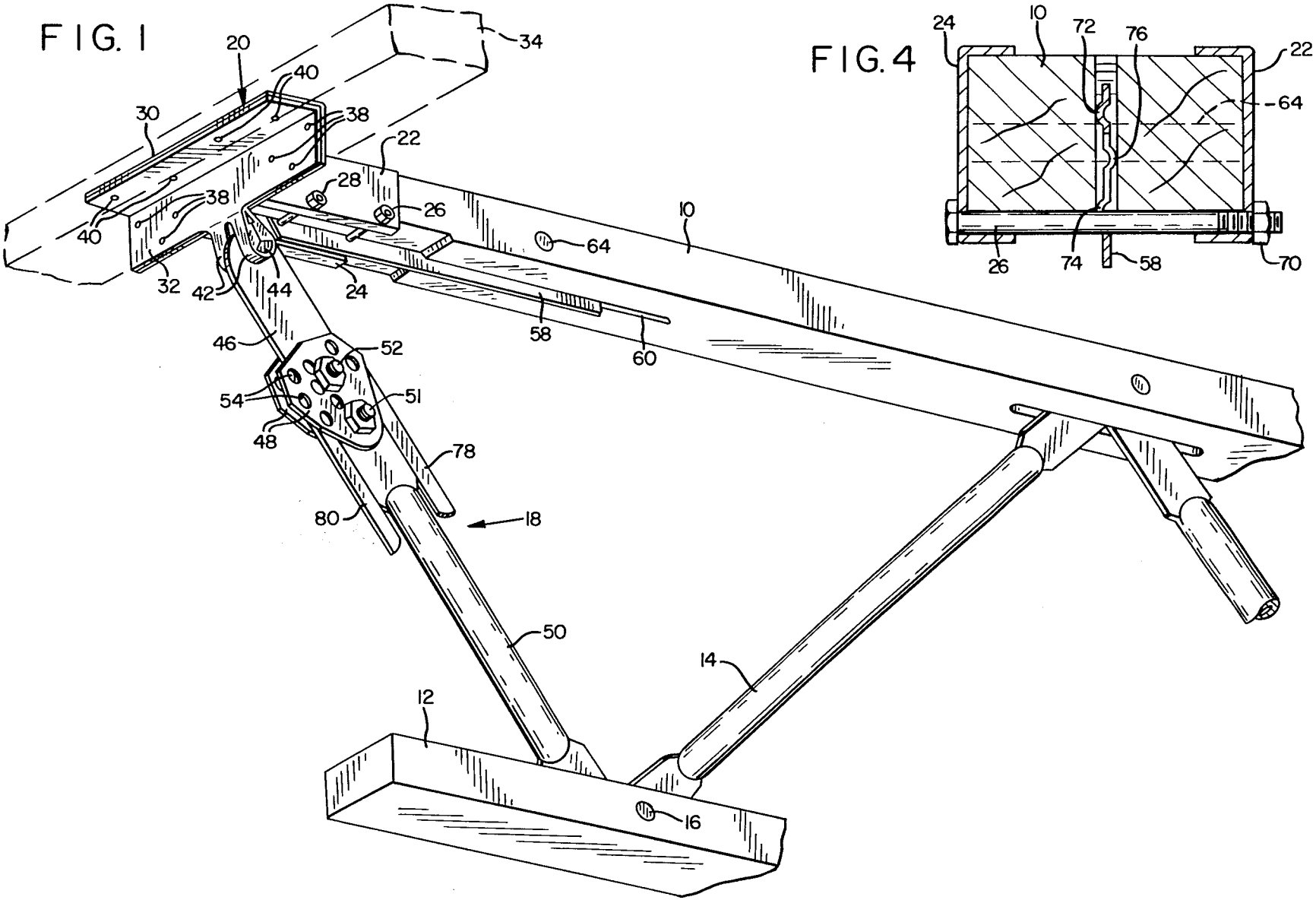
FIG. 1 is a perspective view of one end portion of the open web structural support member of the present invention.
FIG. 4 is an enlarged vertical section view taken along the lines 4—4 of FIG. 3.

As shown in FIGS. 1 and 2, the structural support member of the present invention may be an open web truss including an upper chord member 10 of wood and a lower chord member 12 of wood. The chord members may be solid lumber such as a two-by-four but are preferably made of laminated wood veneer with the laminations running in a vertical direction for increased strength. The chord members 10 and 12 are interconnected by a plurality of spaced, inclined web members 14 of metal which may be tubular metal members having flat ends. The flat ends of the web members are attached to the chord members by connecting pins 16 each extending through an aperture in the end of the web member and through holes drilled horizontally through the approximate center of the side of the chord. In addition, each end of the truss apparatus is provided with an adjustable end web assembly 18 which is connected at its lower end to the lower chord member 12 and at its upper end to a mounting bracket 20. The mounting bracket 20 is provided with two U-shaped channel portions 22 and 24 into which the end of the upper chord member 10 extends. The upper chord member is held between such channel portions by a connector means including a pair of attachment bolts 26 and 28 which extend through the channel portions and are secured by associated nuts. The mounting bracket 20 may be a flush mount bracket whose upper surface is in substantially the same plane as the top of the end support on which it is mounted as shown in greater detail in U.S. patent application Ser. No. 852,732, referred to above.

As shown in FIG. 3, the mounting bracket 20 includes an L-shaped bracket portion formed by a horizontal top portion 30 and a vertical front portion 32 extending laterally outward from the channel portions 22 and 24. The bracket top portion 30 rests on the top surface of an end support member such as a wooden plate 34 secured to the top of a concrete wall 36. The front portion 32 of the bracket is secured to the front surface of the top plate 34 in any suitable manner such as by nails extending through holes 38 in such side portion. Nail holes 40 are also provided in the top portion 30 of such bracket for nailing it to the top surface of the top plate 34 as shown in FIG. 1.

The mounting bracket 20 is provided with a pair of connector arms 42 which extend downwardly from the bottom of front portion 32 and outwardly away from the top plate 34 and concrete wall 36. A connector pin 44 is held captive in a passage extending through the connector arms 42 and passes through an aperture in a first web link member 46 positioned between such arms to secure such link members to the mounting bracket of fixed length. A pair of second web link members 48 which are apertured plates form a link portion of variable length. Link plates 48 are secured at their lower ends by a bolt 51 through the flat upper end of an end web member 50 of fixed length which may be of a similar configuration but shorter length to the other web members 14. The pair of second link members 48 are positioned on opposite sides of the first link member 46 and are connected to such first link member by a coupling bolt 52 which extends through a connector hole in the first link member 46 and also through a selected one of a plurality of adjustment apertures 54 provided in each of the second link members 48.

The effective length of the link means formed by the first link member 46 of fixed length and the second link members 48 of variable length is adjusted by inserting the coupling bolt 52 in different selected ones of nine adjustment apertures 54 in the second link members 48. Each of the adjustment apertures 54 is spaced a different predetermined distance from the attachment hole in such second link members through which the web attachment bolt 51 extends. For example, the incremental distances between the nine adjustment holes 54 may be $\frac{1}{4}$ inch so that the distance from such adjustment holes to the connection hole for bolt 51 varies in $\frac{1}{4}$ inch increments of length in the range from 2 to 4 inches. As shown in FIG. 3, nine adjustment holes 54 are provided for incremental adjustment of the length of the end web assembly 18 in nine steps which are equal in number to the adjustment holes employed for adjusting the length of the truss at the upper chord member 10 as hereafter described.

As shown in FIG. 3, the effective length of the second link members 48 when the connecting bolt 52 is in the third adjustment aperture 54A is the distance 56A of $2\frac{1}{2}$ inches between the centers of such aperture and the connection bolt 51. However, if the connecting bolt 52 is moved to the next highest or fourth adjustment aperture 54B, the effective length of the link arm increases to distance 56B of $2\frac{3}{4}$ inches. Similarly, if the connecting bolt 52 is moved to the fifth adjustment aperture 54C, the length of the link arm is further increased to a distance 56C of 3 inches. The result is that the end web member 18 is adjusted in length in predetermined increments rather than continuously adjusted unknown amounts.

In order to adjust the length of the truss apparatus, two apertured chord plates 58 are provided, each mounted within a slot 60 routed in a different end of the upper chord member 10. As shown in FIG. 3, a plurality of adjustment apertures or holes 62 are provided in the chord plate 58 and are spaced apart longitudinally along the length of the upper chord member 10 in predetermined increments which may be uniform increments of, for example, ½ inch. Nine adjustment holes 62 are provided in two horizontal rows displaced vertically including a bottom row of five holes and a top row of four holes. A selected one such hole is engaged by a coupling pin 64 of, for example, ½ inch diameter, extending through a hole in the side of the upper chord member 10 which is drilled through the approximate center of the height thickness of such chord member.

If the coupling pin 64 is moved from the third hole position of the lower row shown in FIG. 3 to one of the adjustment apertures 62 in the upper row of holes, such as fourth hole 62B, the upper chord member 10 must be moved upward on the order of about ½ inch with respect to the mounting bracket 20. This vertical movement of the chord plate 58 is possible because the fastening bolts 26 and 28 securing the channel portions 22 and 24 of such mounting bracket to the chord plate extend through vertical slots 66 and 68 in such chord plate. In addition, such vertical slots 66 and 68 also allow the use of upper chord members 10 of different height thickness in the range of 1¾, 2, 2¼, 2½ and 2⅞ inches to provide trusses of different load capacities. As shown in FIG. 4, the bolts 26 and 28 each have a nut 70 threaded thereon for clamping the end of the upper chord member 10 between the channel members 22 and 24 when the nuts are tightened.

As shown in FIGS. 3 and 4, the chord plate 58 may be provided with two stiffening ribs 72 and 74 extending longitudinally along such chord plate substantially the entire length of such plate. In addition, a third stiffening rib 76 is provided in the middle of the chord plate in the area where slots 66 and 68 are formed. It should be noted that such stiffening ribs may be eliminated by making the chord plate 58 thicker, such as of ¼ inch thick plate. The chord plate 58 extends into contact with the front portion 32 of the mounting bracket and is secured to the bracket by the bolts 26 and 28 extending through slots 66 and 68 while the upper chord member 10 is secured to the chord plate 58 by the coupling pin 64. In this manner, the upper chord member 10 is secured through the chord plate 58 and bolts 26 and 28 to the mounting bracket 20 and the upper chord member 10 is secured to the end support wall 36 at the top plate 34 by mounting bracket 20.

The effective length of the upper chord member 10 is adjusted in ½ inch increments over a 4-inch adjustment range of +2 inches to −2 inches by changing the location of the coupling pin 64 between the nine different adjustment holes 62 in the chord plate 58. Corresponding adjustments are made in ¼ inch increments to the length of the end web assembly 18 by changing the location of bolt 52 between the nine different adjustment holes 54 in the link plates 48 to provide a rigid stable truss. It should be noted that if the upper chord member 10 is in engagement with the front portion 32 of the mounting bracket 20 in the position of the coupling pin 64 shown in FIG. 3 and it is desired to shorten the length of the truss apparatus, then the end of the upper chord member must be sawed off to allow such chord member to move to the left so that the coupling pin 64 can be put into one of the two adjustment holes to the right of the third adjustment hole which it occupies in FIG. 3.

The first link member 46 is provided with a pair of fork arms 78 and 80, which extend downward below the opening for bolt 52 on opposite sides of the flattened end of the end web member 50, as shown in FIGS. 3 and 5. The fork arms 78 and 80 serve as stops which engage the sides of the flattened end of the end web member 50 to prevent the end web assembly from collapsing due to an upward compressive force which might be applied on the adjustable end web assembly when an upward wind strikes the lower chord member 12. Thus the fork members 78 and 80 prevent buckling of the truss.

In the preferred embodiment shown, the angular relationship between the axis 82 of the end web assembly is approximately 60 degrees with respect to the longitudinal axis of the chord plate 58. Thus, if a line 84 is drawn from one of the adjustment holes 62 of the chord plate perpendicular to the axis 82 of the end web assembly, a right triangle is formed with an angle of 30 degrees between such perpendicular line 84 and the hypotenuse corresponding to the axis of the chord plate 58. Since the sine 30 degrees is 0.5, the adjustment distance of adjustment holes 54 of the link plate along the axis of the end web assembly, which is opposite to the 30 degree angle, is one-half the adjustment distance of the adjustment holes 62 along the hypotenuse of the triangle. This accounts for the incremental adjustment of the second link members 58 being ¼ inch where the incremental adjustment of the chord member is 1κ inch. Maintaining this 2-to-1 relationship in the adjustment increments for the chord plate holes 62 and the link plate holes 54, results in a rigid and stable truss apparatus in all adjustment positions.

Finally, it should also be noted that the two bolts 26 and 28 allow horizontal forces due to wind or earthquake, tending to cause the support wall 36 to shake, to be transmitted from the wall through the mounting bracket 20 to the chord member 10 through such bolts, the chord plate 58 and the connecting pin 64. This load transfer tends to prevent collapse of the building supported by such truss members.

It will be obvious to those having ordinary skill in the art that many changes may be made in the above described preferred embodiment of the present invention without departing from the spirit of the invention. Therefore, the scope of the present invention should be determined by the following claims.

I claim:

1. A structural support apparatus of the open web type, comprising:

an upper chord member;

a lower chord member;

a plurality of spaced web members interconnecting said chord members;

mounting bracket means attached to the end of said upper chord member and adapted to be secured to an end support;

adjustable connector means for connecting said bracket means to the end of said upper chord member and for adjusting the position of said connector means longitudinally of said upper chord member between a plurality of different predetermined length settings spaced along the length of said upper chord member to provide the structure support apparatus with an adjustable length; and adjustable length end web means for connecting the lower chord member to said mounting bracket means, said end web means including incremental adjustment means for adjusting the length of said end web means in known increments between a plurality of different predetermined length settings corresponding to the settings of said connector means.

2. Support apparatus in accordance with claim 1 in which the connector means includes a chord plate means having a plurality of apertures therein spaced along the plate means corresponding to the settings of said connector means and a coupling element for selectively engaging a selected one of said apertures to secure said upper chord member to said plate means at a selected position.

3. Support apparatus in accordance with claim 2 in which the chord plate is mounted within a slot in one end of the upper chord member.

4. Support apparatus in accordance with claim 2 in which the connector means includes threaded fastener elements extending through a pair of side channel members of the mounting bracket means and the chord plate for clamping the end of the upper chord member between said channel members and for fastening the chord plate to the mounting bracket means.

5. Support apparatus in accordance with claim 4 in which the fastener elements extend through slots in the chord plate to allow vertical movement of the chord plate relative to the fastener elements to positions corresponding to adjustment of the coupling element to different selected settings in the apertures of said chord plate or corresponding to chord members of different height thickness.

6. Support apparatus in accordance with claim 1 in which the end web means includes a first link means of fixed length pivotally connected at a first connection to the mounting bracket means, a second link means of adjustable length pivotally connected at a second connection to an end web member of fixed length, and said incremental adjustment means adjusts the length of said second link.

7. Support apparatus in accordance with claim 6 in which the incremental adjustment means includes a plurality of openings in said second link means and a connector element for selectively engaging a selected one of said openings to secure said first link means to said second link means by said connector element at a coupling point and to adjust the distance between said coupling point and said second connection.

and said second connection.

8. Support apparatus in accordance with claim 7 in which the number and relative positions of the openings in said second link means corresponds to the number and relative position of the apertures in said chord plate.

9. Support apparatus in accordance with claim 6 in which the first link means includes a fork-shaped end portion with two arms extending on opposite sides of that end portion of the end web member which is attached to the second link means at the second connection to prevent the link from collapsing with upward force on the lower chord member.

10. A tusss apparatus, comprising:

an upper chord member;

a lower chord member;

a plurality of spaced web members interconnecting said chord members and including at least one end web member;

mounting bracket means attached to the end of said upper chord member and adapted to be secured to an end support;

adjustable connector means for connecting said bracket means to the end of said upper chord member and for adjusting the position of said connector means longitudinally of said upper chord member between a plurality of different predetermined length settings spaced along the length of said upper chord member to provide the structure support apparatus with an adjustable length; and adjustable length link means for linking the end of said end web member to said mounting bracket means, said link means including incremental adjustment means for adjusting the length of said link means in known increments between a plurality of different predetermined length settings corresponding to the settings of said connector means.

11. Truss apparatus in accordance with claim 10 in which the connector means includes a chord plate means having a plurality of apertures therein spaced along the plate means corresponding to the settings of said connector means and a coupling element for selectively engaging a selected one of said apertures to secure said upper chord member to said plate means at a selected position.

12. Truss apparatus in accordance with claim 11 in which the chord plate is mounted within a slot in one end of the upper chord member.

13. Truss apparatus in accordance with claim 11 in which the connector means includes threaded fastener elements extending through a pair of side channel members of the mounting bracket means and the chord plate for clamping the end of the upper chord member between said channel member and for fastening the chord plate to the mounting bracket means.

14. Truss apparatus in accordance with claim 13 in which the fastener elements extend through slots in the chord plate to allow vertical movement of the chord plate relative to the fastener elements to positions corresponding to adjustment of the coupling element to different selected settings in the apertures of said chord plate or corresponding to different height thickness chord members.

15. Truss apparatus in accordance with claim 10 in which the link means includes a first link means of fixed length pivotally connected at a first connection to the mounting bracket means, a second link means of adjustable length pivotally connected at a second connection to an end web member, and length adjustment means for adjusting the length of said second link.

16. Truss apparatus in accordance with claim 15 in which the length adjustment means includes a plurality of openings in said second link means and a connector element for selectively engaging a selected one of said openings to secure said first link means to said second link means by said connector element at a coupling point and to adjust the distance between said coupling point and said second connection.

17. Truss apparatus in accordance with claim 16 in which the number and relative positions of the openings in said second link means corresponds to the number and relative position of the apertures in said chord plate.

18. Truss apparatus in accordance with claim 15 in which the first link means includes a fork-shaped end portion with two arms extending on opposite sides of that end portion of the end web member which is attached to the second link means at the second connection to prevent the link from collapsing with upward force on the lower chord member.

19. Truss apparatus in accordance with claim 10 in which the mounting bracket means includes mounting means for flush mounting the top of the upper chord member in substantially the same plane as the top of the end support.

20. Truss apparatus in accordance with claim 19 in which the mounting means comprises a bracket of L-shaped cross-section including a top plate portion and a front plate portion, and which includes an attachment arm means for attachment to the adjustable link means extending downward from the bottom of said front plate portion and outward of said front plate portion away from said end support.

* * * * *

UNITED STATES PATENT AND TRADEMARK OFFICE

CERTIFICATE OF CORRECTION

PATENT NO. : 4,745,724

DATED : May 24, 1988

INVENTOR(S) : WILLIAM R. REETZ

It is certified that error appears in the above-identified patent and that said Letters Patent is hereby corrected as shown below:

In the Specification:

In Column 3, line 37, "lines 4-4" should be --line 4-4--.

In Column 6, line 37, "lk inch" should be --1/2 inch--.

In the Claims:

Claim 7, Column 7, line 56, "and said second connection." is repeated and is not shown in original claims.

Claim 10, Column 7, line 68, "tusss" should be --truss--.

Signed and Sealed this

Thirteenth Day of December, 1988

*Attest:*

DONALD J. QUIGG

*Attesting Officer*

*Commissioner of Patents and Trademarks*